US005425521A

United States Patent [19]

Locke

[11] Patent Number: 5,425,521

[45] Date of Patent: Jun. 20, 1995

[54] THERMAL SPACER DEVICE

[75] Inventor: William J. Locke, Lakewood, Colo.

[73] Assignee: Grimm Brothers Plastic Corporation, Wapello, Iowa

[21] Appl. No.: 94,550

[22] Filed: Jul. 20, 1993

[51] Int. Cl.[6] ..... B65D 19/00

[52] U.S. Cl. ..... 248/346; 108/901; 108/51.1; 248/910

[58] Field of Search ..... 248/346, 910, 678, 633; 108/51.1, 90.1, 57.1, 52.1, 53.1; 206/386, 557

[56] References Cited

U.S. PATENT DOCUMENTS

| | | | |
|---|---|---|---|
| 2,148,150 | 2/1938 | Clark . | |
| 2,393,245 | 1/1946 | Hadsell . | |
| 2,455,197 | 5/1946 | Sullivan | 108/57.1 X |
| 2,692,107 | 12/1952 | Ridder et al. . | |
| 2,781,643 | 2/1957 | Fairweather . | |
| 2,928,638 | 3/1960 | Parker | 108/52.1 X |
| 3,159,115 | 12/1964 | Nolan | 108/51.1 |
| 3,187,518 | 6/1965 | Bair et al. . | |
| 3,255,607 | 6/1966 | Bair et al. . | |
| 3,404,642 | 10/1968 | Belcher et al. | 108/57.1 |
| 3,699,902 | 10/1972 | Allgeyer et al. . | |
| 3,717,922 | 2/1973 | Witkowski . | |
| 3,719,157 | 3/1973 | Arcocha et al. . | |
| 3,795,206 | 3/1974 | Utz | 108/51.1 |
| 4,428,306 | 1/1984 | Dresen et al. . | |
| 5,092,251 | 3/1992 | Hamaker et al. . | |
| 5,101,737 | 4/1992 | Gomez . | |
| 5,211,117 | 5/1993 | Beamer | 108/51.1 |
| 5,291,836 | 3/1994 | Beamer | 108/51.1 |
| 5,295,445 | 3/1994 | Locke et al. | 108/57.1 |
| 5,299,691 | 4/1994 | Winski | 108/53.1 X |

FOREIGN PATENT DOCUMENTS

| | | | |
|---|---|---|---|
| 139272 | 11/1950 | Australia | 108/52.1 |
| 1252138 | 10/1967 | Germany | 108/53.1 |
| 1956615 | 5/1971 | Germany | 108/901 |
| 2333811 | 7/1973 | Germany . | |

*Primary Examiner*—Karen J. Chotkowski
*Attorney, Agent, or Firm*—Timothy J. Martin

[57] ABSTRACT

A spacer device for a product employs a plurality of elongated first channel structures interconnected by a plurality of interconnecting support structures. The first channel structures have a pair of sidewalls, a top wall, a bottom wall and a pair of endwalls defining a channel interior. The support structures interconnect the first channel structures at spaced locations to hold them in spaced apart relation to form a first lattice having a plurality of openings to permit air circulation. Preferably, a similar second lattice is employed and is inverted and joined with the first lattice to create an endless channel. The support structures on each of the lattices are positioned to enclose the channel interiors on the other of the lattices. The spacer device may also be configured as a container with the lattice openings eliminated so that the spacer device forms an enclosure to contain products. Foam or fluid may be used to fill the channel interiors, if desired.

17 Claims, 5 Drawing Sheets

THERMAL SPACER DEVICE

FIELD OF INVENTION

The present invention generally relates to spacers known as pallets. In particular, the present invention concerns spacer devices used in freezer facilities to support materials which can be packaged in boxes, bags, barrels, crates, bailed, bundled or coiled, and which are being frozen or chilled. More specifically, the present invention concerns a spacer device adapted to facilitate the cooling of these materials.

BACKGROUND OF THE INVENTION

The method for preserving perishable foods has changed in recent years. Early preservation methods included smoking, salting, drying or canning. Presently, the most common method of preserving food is freezing. A variety of different types of products can be frozen, such as yogurt, ice cream and butter, along with meat products such as pork products, chicken products and beef products. When frozen products are boxed and refrigerated, spacers are usually placed between the layers of boxes. Accordingly, the change in preservation techniques to freezing products has increased the use of the spacer in many industries including the meat industry. The greatest proportion of these spacers, that are in common use, are constructed substantially of wood. Wooden spacers or pallets, however, have certain disadvantages. Wooden pallets have sharp edges and corners which can cause tears in the boxes containing the frozen products. Similarly, the wood pallets may damage the boxes by snagging the boxes on protruding nails or staples used to keep the pallet together. Furthermore, wooden spacers are relatively thick and heavy to provide the required compression strength to support the heavy frozen products. Moreover, wood pallets tend to deteriorate rapidly due to wear, warpage and breakage, therefore requiring not only frequent repairs but also large maintenance expenses.

As the food industry becomes more regulated, additional disadvantages relating to the use of wood pallets have been recognized. A pallet that is made of wood is basically an insulating product and thus, increases the time required to freeze the boxed food products placed thereon. Where the freezing of meat is concerned, this delay can increase the likelihood of bacteria growth. Likewise, unless the pallets are pre-cooled, frozen products, e.g., ice cream, may melt due to the thermal capacity of the pallet. Furthermore, the FDA is now scrutinizing the use of wood pallets in the meat industry to determine whether these pallets should be eliminated altogether due to the fact that wood absorbs blood from meat that may leak through the box. If a wood pallet is stained with blood, the pallet must be buried or burned, neither of which is particularly an environmentally sound practice. As an alternative to the use of a wood pallet, the industry has recently turned to the use of metal spacers. Metal spacers compared to wooden spacers decrease the time to freeze the products placed thereon. However, metal spacers, like wood spacers, tend to be heavy to provide the necessary stability. In my co-pending application Ser. No. 07/705,281, a metal spacer device is shown that is stable and lightweight. However, like wood pallets, most metal pallets can deteriorate quickly due to use and can snag boxes on protruding rivet or pallet edges. Therefore, the industry has limited also developed plastic spacers. There has been only a varying degree of success for plastic spacers. One plastic spacer, which is formed of a lightweight plastic, is called an "egg crate". For most products, the "egg crate" spacer tends to be too fragile and too flexible, making it very difficult to lift or move the spacer without boxes falling off of the edges. Another type of plastic spacer in use is formed by a structural foam molding process. Unlike the "egg crate" spacer, this spacer is sturdy; however, it tends to be heavy and it breaks or shatters easily.

Thus, there remains a need in the industry for a stable spacer that is lightweight. Furthermore, the spacer should be formed of a material that does not absorb liquid material which can leak from the products. The industry further requires that the spacer be formed of environmentally-friendly material which is capable of facilitating the freezing or chilling of the product. To this end, the present invention has been constructed to provide a relatively lightweight and strong spacer. Furthermore, the construction of the present invention addresses the industries needs for a durable, cleanable, recyclable spacer. Additionally, the present invention is constructed of material that decreases the time required to freeze the product placed thereon.

SUMMARY OF THE INVENTION

It is an object of the present invention to provide a new and useful pallet or spacer operative to support containers within a temperature regulated environment.

It is another object of the present invention to provide a spacer or pallet that is durable and lightweight in construction.

Another object of the present invention is to provide a spacer or pallet which is shatterproof and which is sufficiently stable to support heavy containers with minimal deformation of its shape.

A further object of the present invention is to provide a spacer that does not absorb any liquid materials that might leak from the containers placed thereon.

Another object of the present invention is to provide a spacer device that is constructed to support unpackaged food products.

Furthermore, another object of the present invention is to provide a spacer that not only supports the containers placed thereon, but also acts to decrease the time required to cool the product.

Additionally, still another object of the present invention is to provide a spacer device that can be readily formed by a variety of processes, especially, twin-sheet pressure forming.

Generally, the spacer device or pallet according to the present invention is operative to support containers having a first temperature in an environment having air at a second temperature. In its broad form, the present invention includes a plurality of elongated first channel structures each having a pair of sidewalls, a top wall and a bottom wall located oppositely of the top wall. The sidewalls, the bottom wall and the top wall of each channel structure define a channel interior for the respective channel structure. A plurality of interconnecting support structures interconnect the first channel structures at selected spaced locations therealong so that the first channel structures are maintained in a spaced-apart relation to one another. The first channel structures and the support structures are operative to permit rapid transfer of thermal energy between the containers and the environment.

More specifically, in one embodiment of the present invention, the plurality of channel structures and interconnecting support structures form an enclosure which is adapted to support unpackaged food products. Within the enclosure is an endless channel which can be filled with foam or fluid. The channel filling material can be injected into the endless channel through a port formed with the enclosure.

In another alternative embodiment of the present invention the first channel structures and the support structures together form a lattice. The lattice has a plurality of openings such that, when the containers are supported by the spacer device the lattice permits air to circulate through the openings and around the first channel structure and the containers. This spacer device like all of the embodiments of this invention is operative to permit rapid transfer of thermal energy between the containers and the environment. This results in less wasted energy and a faster freeze time.

In a preferred embodiment of the present invention the spacer not only has a plurality of first channel structures, but also has a plurality of elongated second channel structures at right angles to the first channel structures. Each second channel structure has a pair of sidewalls, a top wall and a bottom wall located oppositely of the top wall which form a channel interior for the elongated second channel structure. The invention includes a plurality of interconnecting support structures which interconnect the second channel structures at selected spaced locations so that the second channel structures are maintained in a spaced-apart relation to one another. The interconnecting support structures are formed as panels which form the bottom wall of the first and second channel structures at the selected locations.

Preferably, the sidewalls of the first channel structure are constructed to diverge outwardly from the top wall to the bottom wall so that the air can readily contact containers when stacked on the top wall. These side walls terminate in flanges which project outwardly from the sidewalls in spaced apart parallel relationship with the top wall of the channel structures. The present invention forms a framework which contains an endless channel defined by the interconnecting structure and the first and second channel structures. In some embodiments the present invention, the first and second lattice structures are mirror images of each other when the first and second lattice structures are mounted together and secured one to another, the second lattice structure is rotated 90° from the mirror image position so that the second channel structures are oriented transversely to the first channel structures. Some embodiments can include attachment elements operative to connect the first lattice and the second lattice one to another. The attachment element can be selected from a group consisting of: weldments, rivets, screws, crimping and adhesives. Foam or fluid can be disposed with the endless channel within the framework to facilitate the transfer of thermal energy. The foam can be a urethane material or the like. The fluid can be selected from a group consisting of: water, freon, ethylene glycol, polyethylene glycol.

These and other objects of the present invention will become more readily appreciated and understood from a consideration of the following detailed description of the exemplary embodiments when taken together with the accompanying drawings, in which:

BRIEF DESCRIPTION OF DRAWINGS

FIG. 8(*b*) is a perspective view of an alternative exemplary embodiment of the present invention;

FIG. 8(*c*) is a perspective view of an alternative exemplary embodiment of the present invention;

DESCRIPTION OF THE EXEMPLARY EMBODIMENTS

The present invention is generally directed to a spacer device, i.e. a pallet, which supports containers or food products in a manner to allow air circulation and thermal transfer of heat between the container and the storage environment. The transfer of heat is increased by the structural shape of the spacer device, the material used to form the spacer device and by the material placed within its interior. Preferably, the spacer device is formed to provide heat transferring surfaces which, when in contact with the containers or products stacked thereon, lower the temperature of the containers and products quickly. The spacer device of the present invention is particularly useful because it is cleanable, durable, lightweight and relatively inexpensive to manufacture. To this end, spacer devices described according to the present invention include a plurality of channel structures and a plurality of interconnecting support structures which maintain the channel structures in a spaced-apart relationship to each other.

Figure 1:
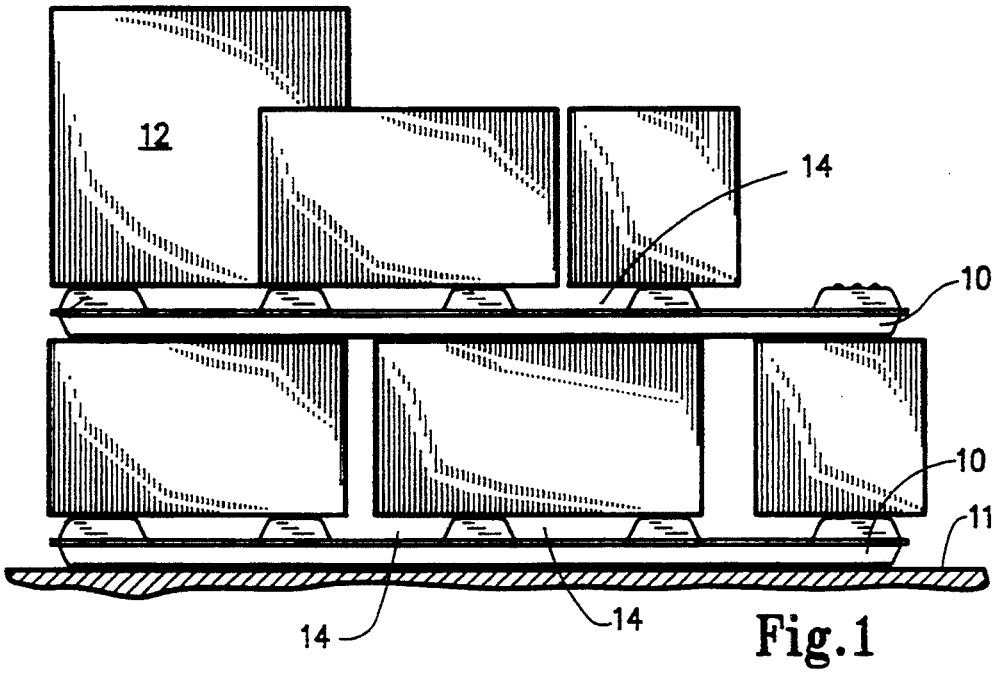
FIG. 1 is a side view in elevation of a pair of spacers according to the present invention in use with plurality of containers supported thereon.

The primary use of spacer devices according to the present invention is shown in FIG. 1 where a pair of spacer devices 10 support a plurality of layers of containers 12 on a support surface 11. Containers 12 may hold food or other products that need to be chilled or frozen. Here it may be seen that gaps 14 located between the container 12 and each spacer device 10 allow cold air to be circulated around each container 12 and each spacer device 10, thus permitting the contents of the containers 12 to freeze faster. For example, containers 12 are at an original first temperature $T_1$ when placed in an environment, such as a freezer, a cold storage or a refrigerated truck, etc., that has a second temperature $T_2$ which is maintained by suitable heating or cooling equipment (not shown). While the temperature $T_1$ may be warmer or colder than the temperature $T_2$, the spacer device 10 is particularly useful in the freezing or chilling of the contents in containers 12. Typically, therefore, $T_2$ is no more than 32° F. (0° C.) and $T_1$ is greater than 32° F. (0° C.). In any event, the spacer device 10 is operative to increase the transfer of thermal energy between the containers 12 and the surrounding environment, so that over a period of time, temperature $T_1$ is in equilibrium with $T_2$. Decreasing the time required for $T_1$ to reach equilibrium with $T_2$ is a primary goal of the present invention.

The construction of a first exemplary embodiment of a spacer device 10 according to the present invention is best shown in FIGS. 2–5. In these figures, spacer device 10 is formed by a plurality of elongated first channel structures 20. The first channel structures 20 have a plurality of interconnecting support structures 50 at selected locations along the length of each of the first channel structures 20. The embodiment shown in FIGS. 2–5 has first channel structures 20 and five interconnecting support structures 50 between each parallel first channel structure. This 5×5 construction can be employed to support heavy containers or boxes such as the containers used by the meat industry.

First channel structures 20 are positioned in a spaced-apart parallel relationship to one another, and the interconnecting support structures 50 secure the first channel structures 20 in such orientation. The interconnecting support structures 50 are preferably formed transversely to the first channel structures, and specifically in FIG. 2, the interconnecting support structures 50 are at right angles to the first channel structures 20.

Figure 3:
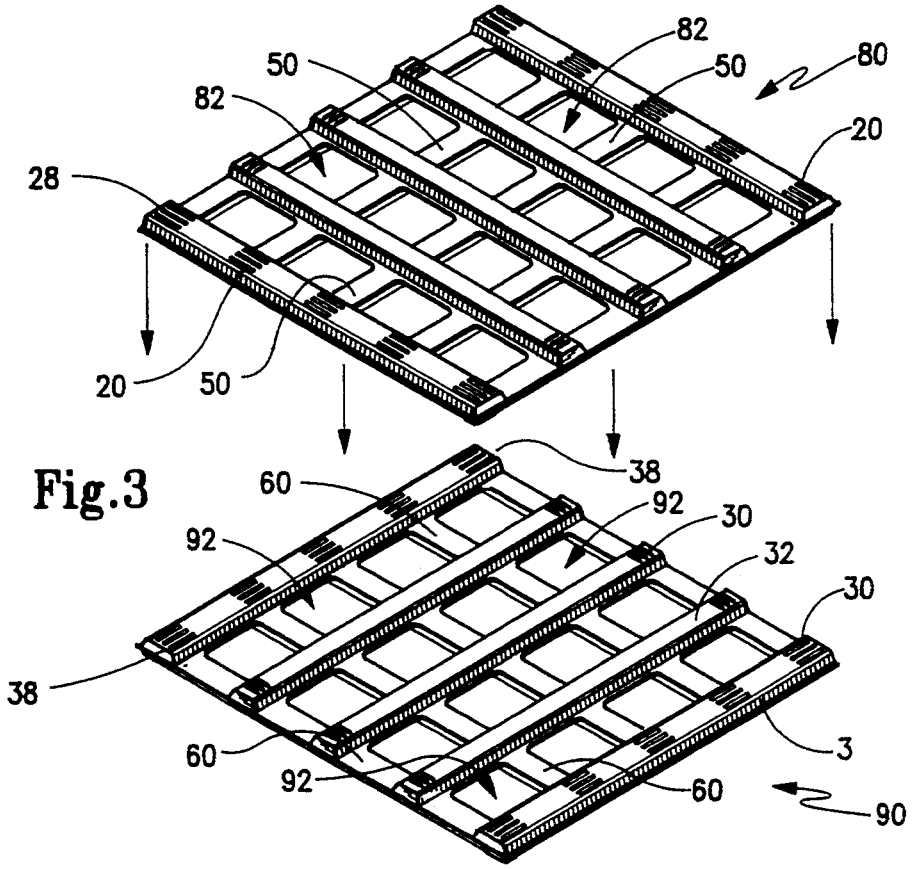
FIG. 3 is an exploded view of the spacer device of FIG. 2 showing the first and second lattice structure.

In the exploded view of FIG. 3, the construction of a spacer device in accordance with an exemplary embodiment of the present invention is shown in more detail. In FIG. 3, the plurality of first channel structures 20 and interconnecting support structures 50 form a first lattice 80. The first lattice 80 has a plurality of spaced apart first lattice openings 82 formed by first channel structures 20 and interconnecting support structures 50. Likewise, a plurality of second channel structures 30 are rigidly supported in a parallel spaced apart relationship one to another by interconnecting support structures 60 at selected locations along the second channel structures 30. The second channel structures 30 and the interconnecting support structures 60 accordingly form a second lattice 90. The second lattice 90 has a plurality of spaced apart second lattice openings 92 defined by the second channel structures 30 and the interconnecting support structures.

Figure 2:
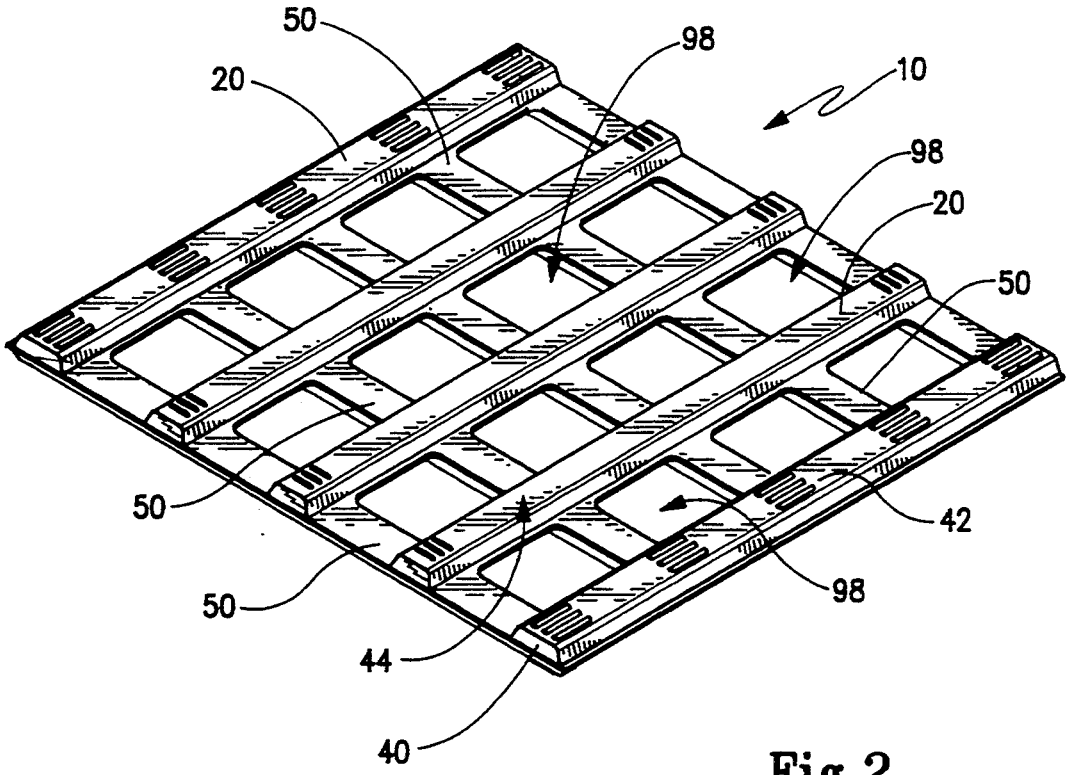
FIG. 2 is a perspective view of a spacer device according to a first exemplary embodiment of the present invention.
Figure 4:
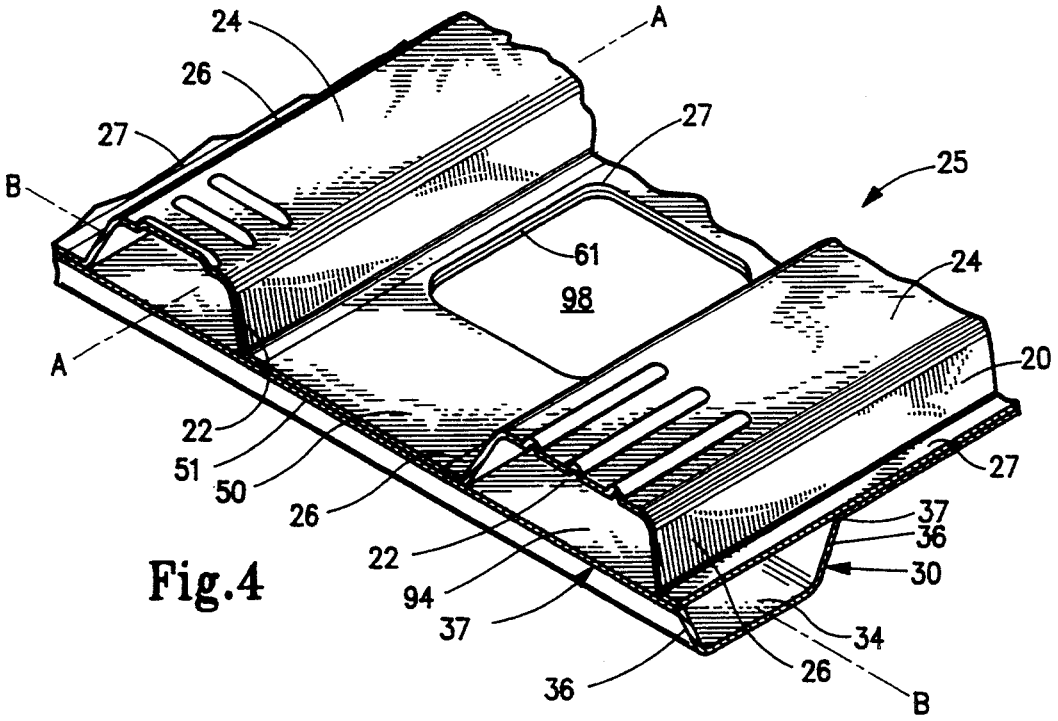
FIG. 4 is a perspective view in cross-section showing the intersection of a pair of channel structures used to construct the spacers shown in FIGS. 1 and 2.

The first lattice structure 80 and the second lattice structure 90 together form a framework that has spaced apart framework openings 98 shown in FIGS. 2 and 4. The framework openings 98 are formed by the alignment of the first lattice openings 82 with the second lattice openings 92. These framework openings 98 permit the air to freely circulate around containers 12 stacked on spacer 10 as is shown in FIG. 1.

To form the framework, the first lattice structure 80 is positioned so that the first channel structures 20 are oriented in a first position shown in FIG. 3. The second lattice structure 90 is a mirror image of the first lattice structure 80 and is inverted and rotated 90° so that the second channel structures 30 are oriented in transversely to first channel structures 20. Thus, the interior of first and second channel structures 20 and, which respectively define channels 22, 32 (as shown in FIG. 4) open oppositely of one another. Second channel structures 30 are accordingly positioned at a 90° angle relative to the first channel structures 20. Likewise, interconnecting structures 50 and 60 are oriented transversely to one another. As is clearly shown in the figures, the number of interconnecting support structures 60 which connect adjacent ones of the first channel structures 20 to one another is equal to the number of second channel structures 30. Likewise, the number of interconnecting support structures 60 which connect the plurality of second channel structures 30 one to another equals the number of first channel structures 20. Furthermore, the interconnecting support structures 50 and 60 are sized and configured to seal the respective first and second channel structures 20 and 30 when lattices 80 and 90 are secured together.

Accordingly, as shown in FIGS. 2–4, the first and second channel structures 20 and 30 cross one another at corner intersections 40, edge intersections 42, and central intersections 44. Where the first and second channel structures 20, 30 do not intersect, the interconnecting support structures 50' respectively cross the second channel structures 30 and the interconnecting structures 60 crosses the first channel structures 20. Thus the first and second channel structures 20, 30 and their associated channels 22 and 32 in conjunction with the intersecting support structure 50, 60 form within the framework an endless enclosed channel 94. When the first and second lattices 80 and 90 are secured together.

Figure 5:
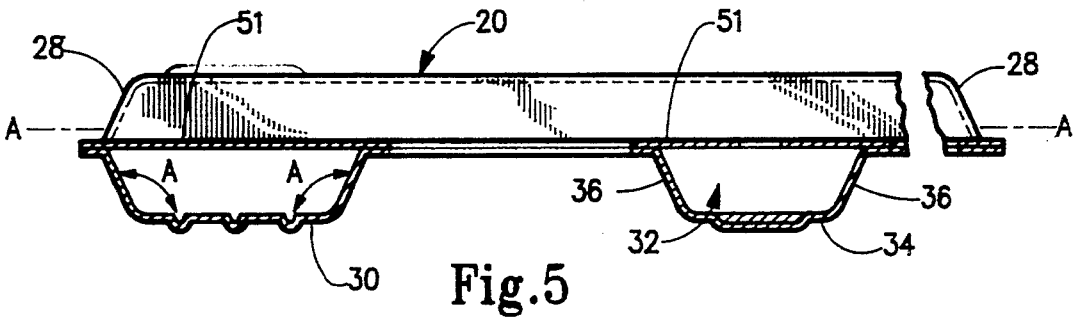
FIG. 5 is a side view showing the intersection of a pair of channel structures.

FIGS. 4 and 5 show the construction of a representative first and second channel structures 20, 30 with greater particularity. The first channel structure 20 has a generally u-shaped first channel 22 with a longitudinal axis A. The first channel 22 is formed of a planar first top wall 24 and a pair of first sidewalls 26 connected to top wall 24 to define the first channel 22. Likewise, the second channel structures 30 include a top wall 34 and a pair of side walls 36 connected to top wall 34. The top wall 34 and the sidewalls 36 define a the channel 32 for a second channel structure 30.

As is shown in FIGS. 4 and 5, the sidewalls 26, 36 respectively diverge outwardly from top walls 24 and 34 at an angle that is at approximately 110°. It was discovered that if angle A is 90° or less, the intersection of the top wall 24, 34 the associated sidewalls 26, 36 can be readily snagged by containers stacked thereon, and the sharp edge formed by the 90° angle may shatter the spacer device if struck. Likewise, if the angle A is made much larger than 110°, air cannot readily circulate around the bottom of the containers which are stacked on the spacers, and thus the exchange of thermal energy between the containers and the environment is less efficient.

Each first channel 22 also includes a pair of end walls 28 located oppositely from one another. The end walls 28 project in a substantially perpendicular relationship to the first top wall 24. Each first channel 22 also includes a pair of laterally projecting flanges 27 which project opposite one another from side walls 26 in a substantially parallel relationship to the first top wall 24. However, at selected locations along the sidewalls 26 of the first channel structure 20, the flanges 27 are extended to form the interconnecting support structures 50.

Likewise, each second channel structure 30 has a u-shaped second channel 32 with a longitudinal axis B. Channel 32 is formed by a planar second top wall 34 and a pair of second sidewalls 36 connected to the second top wall 34. Side walls 36 diverge outwardly from the second top wall 34 at oblique angles again preferably 110° and terminate at selected location in a pair of laterally projecting second flanges 37. These second flanges 37 project oppositely from one another, and are substantially parallel to the second top wall 34. Like the first channel structure 20, the second channel structure 30 includes a pair of second end walls 38 which project opposite one another in a perpendicular relationship to the second top wall 34. At selected locations along the second channel structure 30 the second side walls 36 terminate in the interconnecting support structures 60 which rigidly secure the second channel structures 30 one to another to form the second lattice structure 90.

Accordingly, each of the first channels 22 are enclosed by the interconnecting support structure 60 of the second lattice 90. Similarly, each of the second channels 32 is enclosed by the interconnecting support structure 50 of the first lattice 80. Thus, support structures 50 form a bottom wall 51 opposite top wall 34 for those portions of channels 32 located between adjacent channels 22, and support structures 60 form a bottom wall 61 for those portions of channels 22 opposite top wall 24 located between adjacent channels 32. In the above-described framework, therefore, the first flanges 27 are proximate the interconnecting support structure 50, and the second flanges 37 are proximate the interconnecting support structure 60 when the first lattice 80 and the second lattice 90 are mounted one to another. Thus the flanges 27, 37 and the support structures 50 and 60 and the end walls 28 and 38 form the edges of the framework. The edge of the framework can be secured on to another by attachment elements, as discussed below.

Generally looking at FIGS. 1–6 on the first and second channel structure 20, 30 there is an antiskid structure 3. Turning specifically to FIG. 2, the positioning of the antiskid structure is preferably on the outer channels along the length thereof, and on the ends adjacent the respectively end walls 28, 38 of the first and second inner channel structures. In FIG. 4, the antiskid structure is shown as a ridge that protrudes outward from the top wall 24 of channel structure 20. Likewise, the antiskid structure can protrude from top wall 34 of channel structure 30. The antiskid structure can be placed on all channels or can selected channels.

The first and second channel structures can be formed of a variety of materials. When selecting the material to form the spacer, the following issues should be addressed: 1) the porosity of the material, i.e., it should not absorb fluids that may leak from containers; 2) the burn characteristics, i.e., it should not readily burn nor should it melt or give off toxic fumes; and 3) the strength and flexibility of the material vs. the weight, i.e., it should preferably be lightweight yet strong and slightly flexible. The preferred material is a high density ethylene or high molecular weight ethylene. However, other polymeric material can be readily employed. Alternatively, a metal construction can be employed; here, the metal could be selected from a group such as aluminum, steel, tin, iron, copper, nickel or other suitable metals or alloys.

The preferred process of forming the present invention is by a twin sheet vacuum method. A first sheet of plastic is heated in a vacuum and molded at a first molding station to form the first lattice structure 80. A second sheet of plastic is molded at a second welding station to form the second lattice structure 90. The first and second molded sheets, while heated, are contacted with one another so that the flanges 27 and 37 and the interconnecting support structures 50 and 60 and the end walls 28, 38, which form the edges of the framework are sealed one to another at the areas that the first and second structures. Of course, it will be understood by those skilled in the art that the present invention, where constructed of plastic, can be formed a variety of molding process including variations of the twin sheet vacuum process molding punch and die molding and the like. Examples would be by standard vacuum forming of each lattice, blow molding, injection molding and the like.

Depending on the type of fabrication process selected and the type of material employed to form the spacer device, various attachment methods or elements can be employed to secure the first and second lattice structures. If plastic material is employed to form the first and second lattice, the attachment elements can include adhesive material, weldments (ultrasonic welding), heat sealing and hot melts or other sealants known in the art. If the first and second lattices are formed of a metal material, the attachment elements can include rivets, screws, or crimping and other securing elements known in the art.

Figure 6:
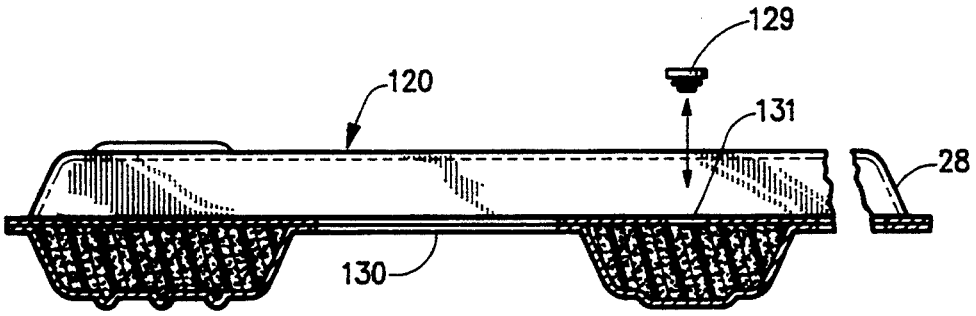
FIG. 6 is a side view in cross-section showing the port in a channel which is filled with material.
Figure 7:
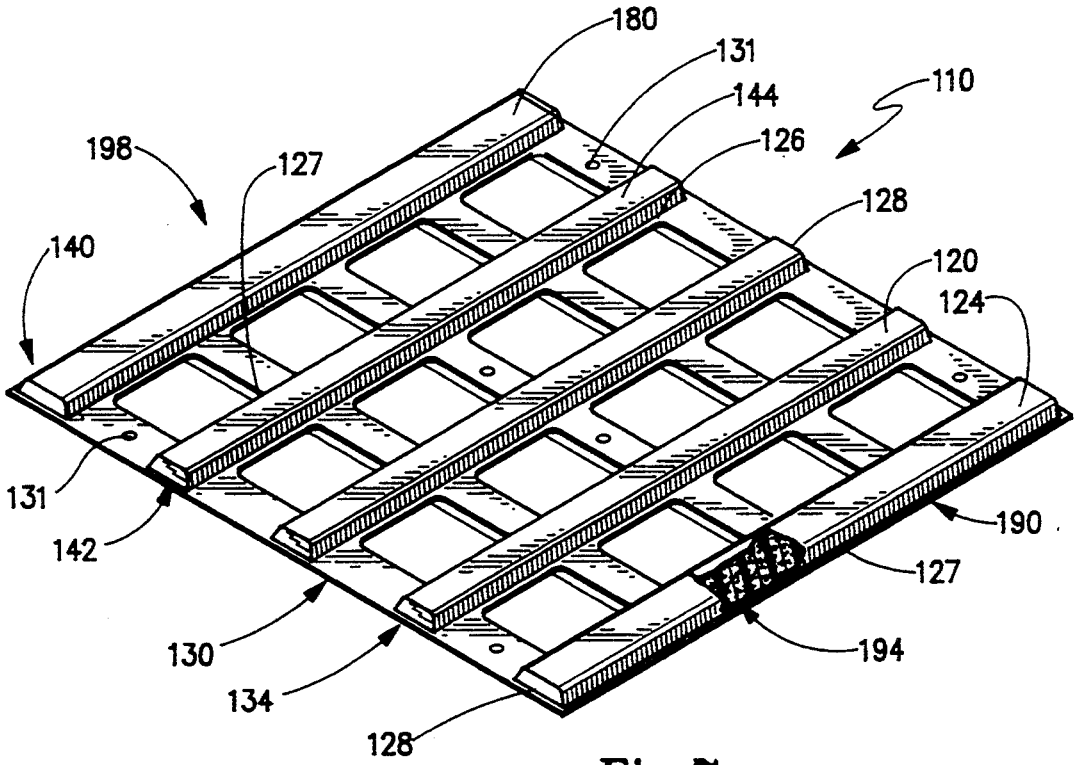
FIG. 7 is a perspective view of a first alternative embodiment of the spacer.

Often, it is desirable to impart additional thermal properties to the spacer device to enhance its thermal capacity. Accordingly, the spacer device may be filled with a thermal medium. For example, then a first alternative exemplary embodiment of the present invention is shown in FIGS. 6 and 7. In FIGS. 6 and 7 the spacer 110 is structured similarly to spacer 10. Spacer 110 includes u-shaped first channel structures 120 and second channel structure 130. As in the embodiment in FIG. 2 of the first and second channel structures 120 and 130 have top walls 124 and 134, a pair of sidewalls 126 and 136, a pair of end walls 128 and 138 with flanges 127 and 137 projecting from the sidewalls 126 and 136 and the end walls 128 and 138. Likewise, the plurality of first and second channel structures 120 and 130 respectively are rigidly interconnected by interconnecting support structures 150, 160 respectively. Each of the respective support structures 150 and 160 are formed as panels 151 and 161. The interconnections of the first and second channel structures 120, 130 include corner intersections 140, edge intersections 142 and central intersections 144. The framework has a first lattice structure 180 and a second lattice structure 190 which define an endless channel 194.

Here, however, one of the first and second channel structures 120 and 130 contain at least one port 131 having a plug structure 129 communicating with the endless channel 194. The port 131 can include an outer recessed portion adapted to accept the top portion of the plug 129. Preferably, the port or ports 131 are located proximate corner intersections 140, or edge intersections 142 or central intersection 144. The port 131 permits access to the endless channel 194 formed within the framework. The endless channel 194 can be filled through port 131 with either polymeric foam material or fluids which are operable to increase the transfer of thermal energy between the containers stacked on the spacers and the surrounding environment. Foamable materials such as polyurethane, polystyrene and the like, can be injected into the endless channel 194 through port 131. Alternatively, the endless channel 194 can be filled with refrigerating fluids such as freon, polyethylene glycol, glycol, water, and the like. After the foam or the fluid is placed in the endless channel 194 the plug structure 129 is secured within the port 131 to seal the foam or fluid within the endless channel 194. The plug structure 129 is preferably flush with the channel structure when mounted in the port 131 so that the plug structure 129 is not readily contacted by containers mounted in the spacer 110.

Figure 8A:
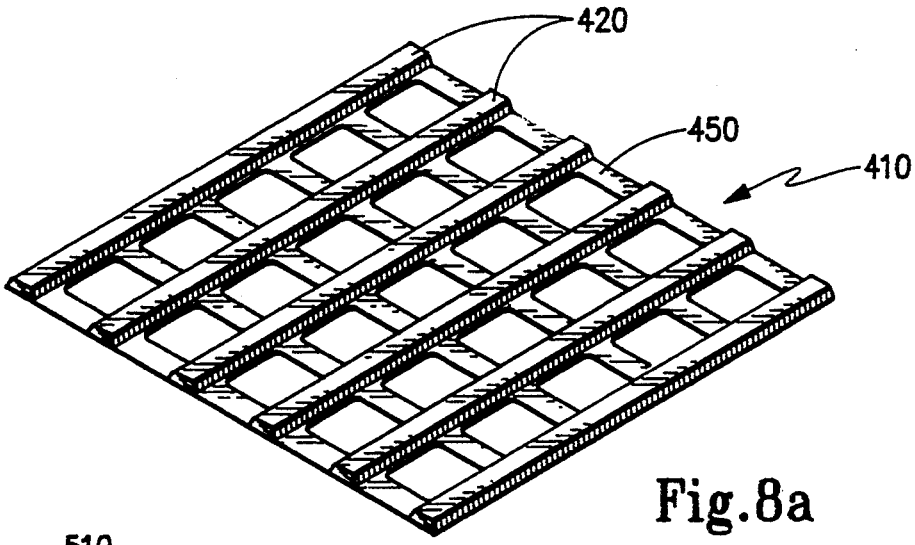
FIG. 8(*a*) is a perspective view of an alternative exemplary embodiment of the present invention.
Figure 8B:
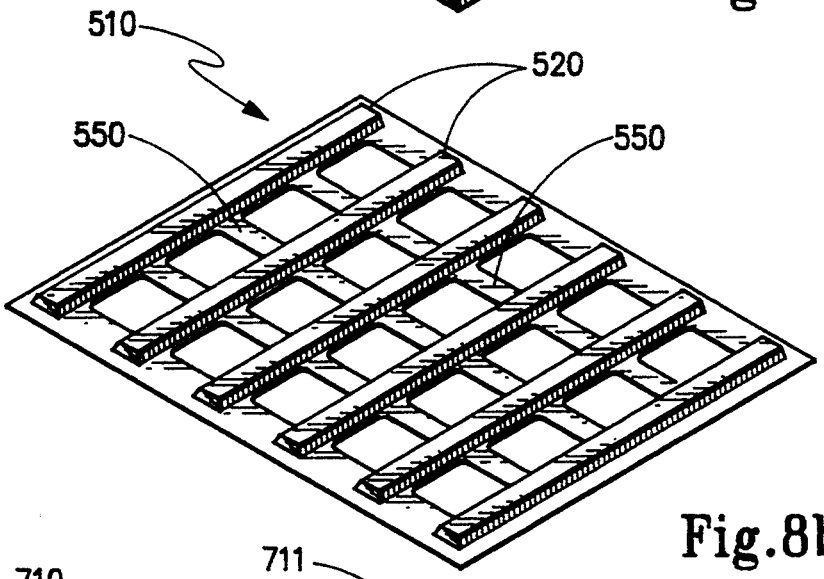
Figure 8C:
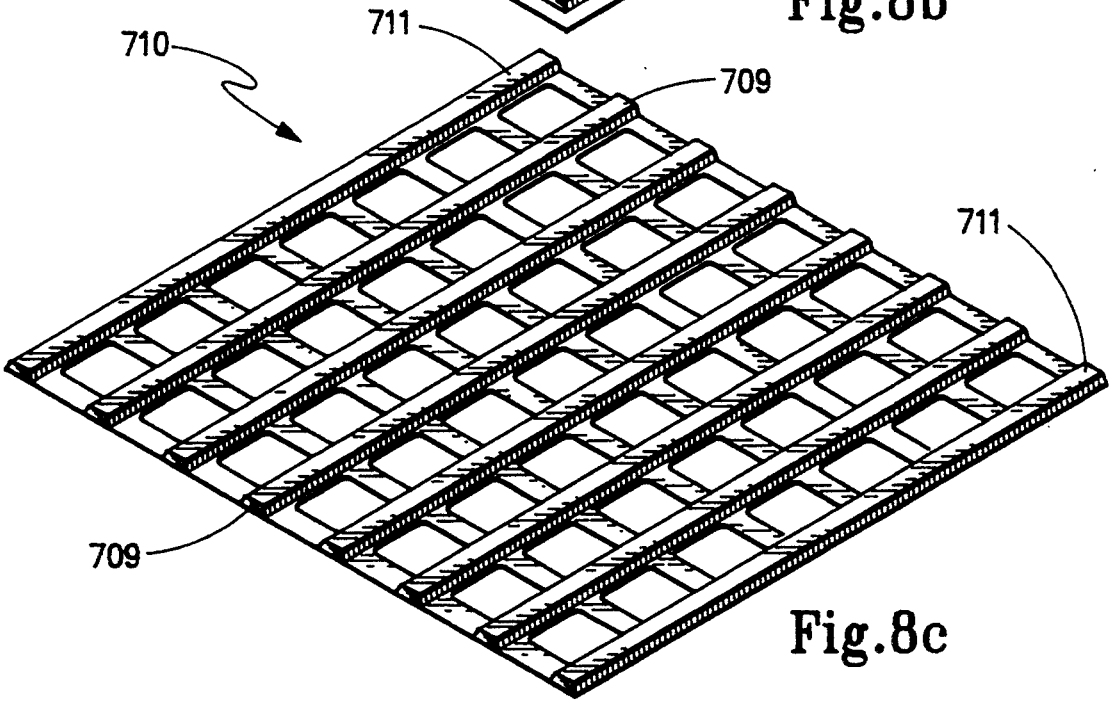

Additional exemplary embodiments of the present invention are shown in FIGS. 8(*a*), 8(*b*) and 8(*c*). Like the exemplary embodiment shown in FIG. 2, the spacers 410, 510 and 710 are formed of a plurality of elongated first channel structures 420, 520 and 720 respectfully. These elongated first channel structures are interconnected one to another by a plurality of interconnecting support structures 450, 550 and 720 respectively.

The embodiment seen in FIG. 2 has five (5) first channel structures 20 interconnected by five (5) interconnecting support structures 50. However, the alternative embodiments 8(*a*), 8(*b*) and 8(*c*) each show different number of elongated first channel structures and interconnecting structures. FIG. 8(*a*) shows six (6) first channel structures 420 and six interconnecting support structures 450 between each parallel first channel structure 420. FIGS. 8(*a*)–8(*c*) unlike FIG. 2 do not show the antiskid structure 3. The antiskid structure could be employed on both outer channel structures and interior channel structures in the various embodiments shown in FIGS. 8(*a*)–8(*c*) of the present invention. FIG. 8(*b*) shows a six (6) by five (5) configuration, six (6) first channel structures 520 and five (5) interconnecting support structures 550. The six (6) by five (5) spacer shown in FIG. 8(*b*) works well with light weight containers such as frozen dairy products, but may be slightly too flexible for heavier containers. A more stable spacer may be constructed by using slightly larger outer channel structures. Outer channel structures 711 shown in FIG. 8(*c*) are slightly wider in cross-section then inner channel structures 709. The wider outer channel structures 711 stabilize and strengthen the spacer 710 making it less flexible. The use of wider outer channel structures could be employed in any of the embodiments of this invention. Thus, it should be clearly understood that different numbers of channel structures and interconnecting support structures could be organized together to construct a spacer according to the present invention.

Figure 9:
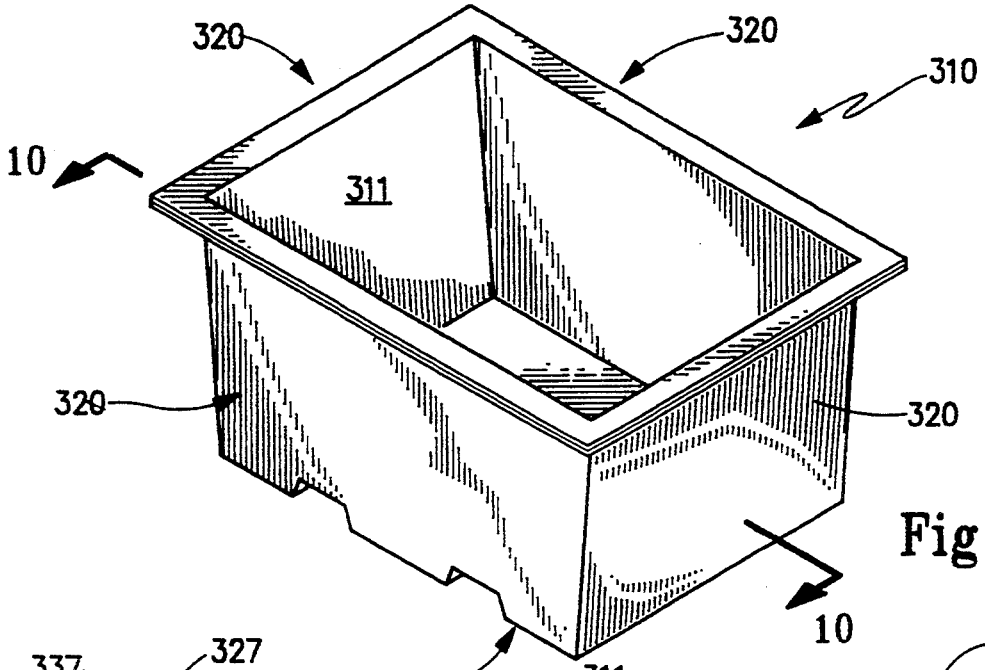
FIG. 9 is a perspective view of yet another alternative embodiment of the present invention showing a spacer device configured as a box-like container.

FIG. 9 shows another exemplary embodiment of the present invention. This embodiment can be employed to support unpackaged food products within a refrigerated environment. For example, in meat packing plants, certain products are not boxed when frozen. These products can be placed in the embodiment shown in FIGS. 9–11. These embodiments 310 have a plurality of elongated first channel structures 320. Here, however, the first channel structures 320 are oriented at right angles one to another, thus forming an enclosure 311 that is generally tub shaped.

Figure 10:
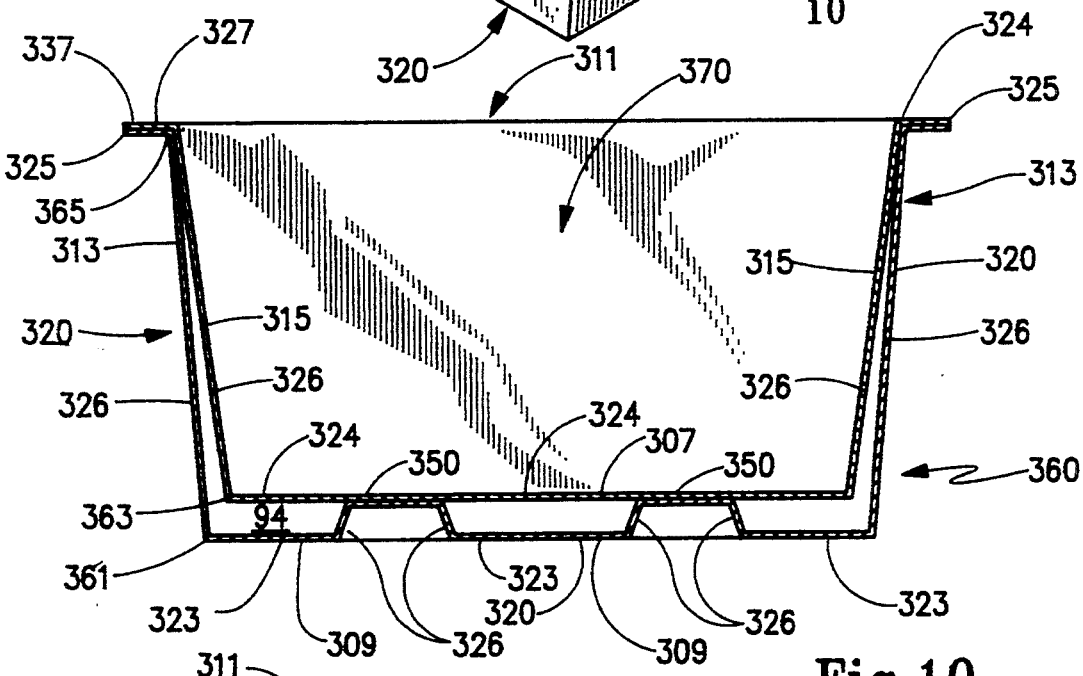
FIG. 10 shows a cross-sectional view taken about lines 10—10 of FIG. 9.

Turning to FIG. 10 it can be seen that each of the plurality of first channel structures 320 has a pair of sidewalls 326, a top wall 324. The top wall 324, the bottom wall 323 and the sidewalls 320 are interconnected by interconnecting support structure 350 so that the first channel structures 320 are maintained in a spaced apart relation to one another. The exterior walls 313 of the enclosure 311 are formed of one of each pair of sidewalls 326 of the plurality of first channel structures 320. The bottom exterior wall 309 of the enclosure 311 is formed by the bottom wall 323 of one of the first channel structures 320. The interior walls 315 of the enclosure 311 are likewise formed of the opposite one of some of the pairs of sidewalls 326 of the first channel structure 320. The bottom interior wall 307 is formed by the top wall 324 of one of the first channel structures 320. The exterior wall 313 and the bottom exterior wall 309 form an outer shell 360. The interior wall 315 and the bottom interior wall 307 form an inner shell 370. As can be readily seen in FIG. 10 the inner shell 370 is mounted within the outer shell 360.

Figure 11:
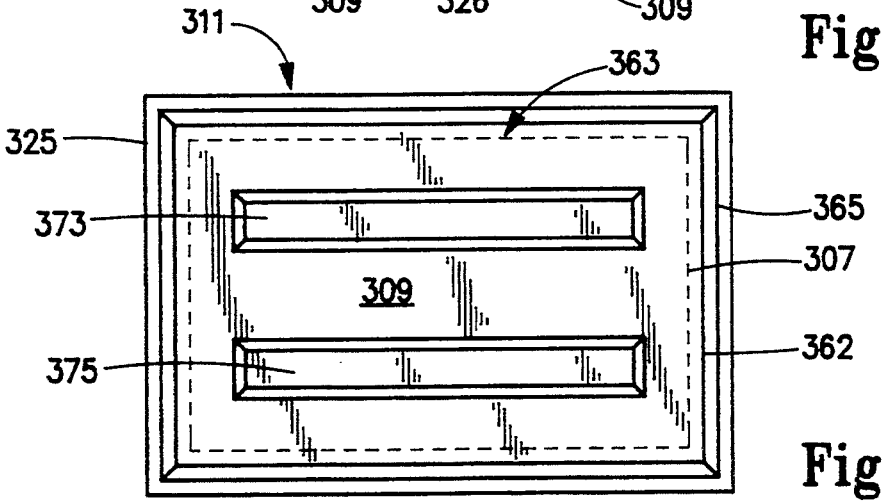
FIG. 11 is the bottom plan view of the alternative embodiment of the present invention shown in FIGS. 9 and 10.

FIG. 11 shows a bottom plan view of the structural configuration of this embodiment. The outer edge of the bottom interior wall 307 of the enclosure 311 is shown in phantom. The outer edge 362 of the exterior bottom wall 309 extends outside of the outer edge 363. Looking at both FIGS. 10 and 11, it can be seen that the exterior wall 313 and the interior walls 315 diverge upwardly and outwardly from the bottom interior wall 307 and the bottom exterior wall 309 respectively. The interior walls 315 diverge at a greater angle then does the exterior side wall 313. Thus, the first channel structures 320 formed by walls 315 and 313 narrow in cross-section from the bottom wall 323 to top wall 324. Outside of the outer edge 362 of the bottom exterior wall 309 is the upper edge 365 of the exterior side wall 313. Exterior side wall 313 and interior side wall 313 both terminate in outwardly projecting flanges 327 and 337 respectively, which form top wall 324 and an outer rim 325 to the enclosure 311.

The bottom wall 309 has two U-shaped recesses 373 and 375. The recesses 373 and 375 each having surrounding recess sidewalls 377 and 379 respective which downwardly diverge from the recess top wall 381 and 383 respectively. These recesses 373 and 375 are operative to permit air to circulate around the bottom portion of the enclosure 311. These recesses 373 and 375 are particularly useful if the embodiment of the present invention shown in FIGS. 9–11 is stacked on one of the other embodiments of the present invention shown in FIGS. 1–8.

The embodiment shown in FIGS. 9–11 like the embodiments shown in FIGS. 1–8 can have a material injected into the endless channel 394 formed between the inner shell 370 and the outer shell 360. If desired, a port may be provided to permit either foamable or liquid material to be placed in the endless channel 394, in a manner similar to that described with respect to the embodiment of FIGS. 2–6. Thus this embodiment of the present invention is operative to change the $T_1$ temperature of the product placed within enclosure 311 to the $T_2$ temperature of the regulated environment quickly. This device is particularly useful when placed on one of the other embodiment of this invention. This device can be employed by the meat industry for example support animal parts such as stomachs, tongues, hearts and the like which are chilled or frozen prior to being packaged in boxes.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A spacer device operative to support product having a first temperature thereon in an environment having air at a second temperature, comprising:

(a) a plurality of elongated first channel structures each having a pair of sidewalls, a top wall and a bottom wall located oppositely of said top wall, said sidewalls, said bottom wall and said top wall of each said channel structure defining a channel interior for a respective said channel structure; and (b) a plurality of interconnecting support structures interconnecting said first channel structure at selected spaced locations there along so that said first channel structures are maintained in a spaced-apart relation to one another, said first channel structures and said support structures thereby operative to permit rapid transfer of thermal energy between the containers and the environment and wherein said first channel structure and said interconnecting support structure form an enclosure operative to contain products.

2. A spacer device according to claim 1 wherein said first channel structure and said interconnecting support structure define an endless channel.

3. A spacer device according to claim 2 including a port in fluid communication with said endless channel, said port operative to fill said endless channel with foam.

4. A spacer device according to claim 2 including a port in fluid communication with said endless channel, said port operative to fill said endless channel with fluid.

5. A spacer device operative to support containers having a first temperature thereon in an environment having air at a second temperature, comprising:

(a) a plurality of elongated first channel structures each having a pair of sidewalls, a pair of end walls, a top wall and a bottom wall located oppositely of said top wall, said sidewalls, said bottom wall and said top wall of each and channel structure defining a channel interior for a respective said channel structure; and (b) a plurality of interconnecting support structures interconnecting said first channel structure at selected spaced locations there along so that said first channel structures are maintained in a spaced-apart relation to one another, said first channel structures and said support structures thereby together forming a first lattice having a plurality of openings such that, when said containers are supported by said spacer device, the first lattice permits air to circulate through said openings and around said containers and said first channel structure, said spacer device thereby operative to permit rapid transfer thermal energy between the containers and the environment.

6. A spacer device according to claim 5 wherein said sidewalls diverge outwardly from said top wall to said bottom wall so that the air can readily contact the said container when stacked on said top wall.

7. A spacer device according to claim 5 wherein the side walls of said first channel structure terminate in flanges which project outwardly from said sidewalls in spaced apart parallel relationship with the top wall of said first channel structure.

8. A spacer device operative to support containers in a refrigerated environment comprising:

(a) a first lattice formed of a plurality of elongated first channel structures, a plurality of interconnecting support structures, said plurality of first channel structures each having a pair of sidewalls, a top wall and a bottom wall located oppositely of said top wall, said sidewalls, said bottom wall and said top wall of elongated first channel structure defining a channel interior for an elongated first channel structure, a plurality of interconnecting support structures interconnecting said first channel structure at selected spaced locations there along so that said first channel structures are maintained in a spaced-apart relation to one another;

(b) a second lattice formed of a plurality of elongated second channel structures a plurality of interconnecting support structures, said plurality of second channel structure each having a pair of sidewalls, a top wall and a bottom wall located oppositely of said top wall, said sidewalls, said bottom wall and said top wall of elongated first channel structure defining a channel interior for an elongated first channel structure, a plurality of interconnecting support structures interconnecting said second channel structure at selected spaced locations there along so that said second channel structures are maintained in a spaced-apart relation to one another; and (c) attachment elements operative to secure said first lattice to said second lattice forming a framework that contains an endless channel defined by said interconnecting support structure and said first and second channel structures.

9. A spacer device according to claim 8 wherein said interconnecting support structures are formed as panels which form the bottom wall of said first and second channel structures at the selected locations.

10. A spacer device according to claim 8 including attachment elements operative to connect said first and second channel structures one to another.

11. A spacer device according to claim 10 wherein said attachment element selected from a group consisting of welding rivets.

12. A spacer device according to claim 10 wherein said attachment means includes an adhesive.

13. A spacer device according to claim 8 wherein said framework form as an endless channel by said interconnecting structure, and said first and second channel structures.

14. A spacer device according to claim 13 wherein a foam disposed with the endless channel within said framework.

15. A spacer device according to claim 14 wherein said foam is formed of a urethane material.

16. A spacer device according to claim 13 wherein the endless channel within said framework is operative to contain a fluid.

17. A spacer device according to claim 16 wherein said fluid is selected from a group consisting of: $H_2O$, freon, ethylene glycol, poly ethylene glycol.

* * * * *